United States Patent [19]

Lovewell

[11] 4,182,476

[45] Jan. 8, 1980

[54] CONTAINER AND CABINET THEREFOR

[75] Inventor: Jack S. Lovewell, Philadelphia, Pa.

[73] Assignee: Shell Container Systems, Union, N.J.

[21] Appl. No.: 929,180

[22] Filed: Jul. 28, 1978

[51] Int. Cl.[2] ..... B65D 5/72

[52] U.S. Cl. ..... 229/17 B; 229/45 R; 229/35

[58] Field of Search ..... 229/17 B, 44, 45, 35

[56] References Cited

U.S. PATENT DOCUMENTS

| | | | |
|---|---|---|---|
| 340,904 | 4/1886 | Auchterlonie | 229/17 B |
| 944,467 | 12/1909 | Smith | 229/17 B |
| 2,340,976 | 2/1944 | Nevins, Jr. | 229/17 B |
| 2,536,384 | 1/1951 | Meller | 229/35 |
| 2,803,390 | 8/1957 | MacKay | 229/17 B |
| 2,967,654 | 1/1961 | Palmer | 229/35 |
| 3,010,636 | 11/1961 | Vander Lugt, Jr. | 229/35 |
| 3,019,957 | 2/1962 | Palmer | 229/35 X |
| 3,274,047 | 9/1966 | Sloan | 428/166 |
| 3,370,775 | 2/1968 | Link | 229/17 B |
| 3,827,624 | 8/1974 | Doglitti | 229/45 |
| 4,138,051 | 2/1978 | Zicko | 229/17 B |

OTHER PUBLICATIONS

Shell Container Systems of Ambler, Pa. 19002, Advertising Circular for "The Cubby".

*Primary Examiner*—Davis T. Moorhead

*Attorney, Agent, or Firm*—Lerner, David, Littenberg & Samuel

[57] ABSTRACT

A plastic container is provided having a cover pivotally connected to a bottom wall and provided with side flaps extending therefrom for interconnecting the cover and sidewalls. The side flaps each include an arc-shaped edge and a locking tab formed in the side flap spaced inwardly from the arc-shaped edge, with the locking tab of each side flap being movable out of the plane of the side flap. In addition, each of the sidewalls includes a locking slot formed therein, with each locking slot including a central slot portion and end slot portions forming end locking elements at each end of the central slot portion, with the end locking elements being movable out of the plane of the respective sidewalls. Each of the locking tabs is engageable with and movable relative to a respective locking slot, such that movement of a locking tab to engage one of the end locking elements operates to bias the engaged locking tab and locking element out of their respective planes and to automatically lock the cover of the container in an open or closed position.

A cabinet is also provided for holding a plurality of such containers in an aligned or stacked arrangement.

6 Claims, 4 Drawing Figures

FIG.1
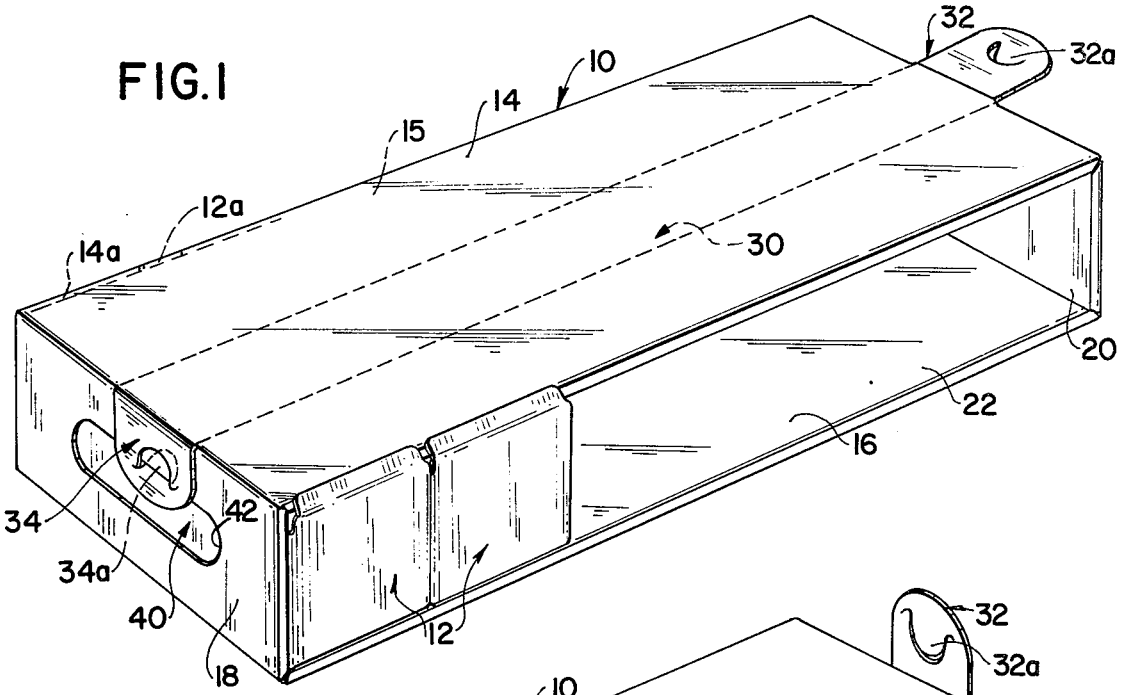
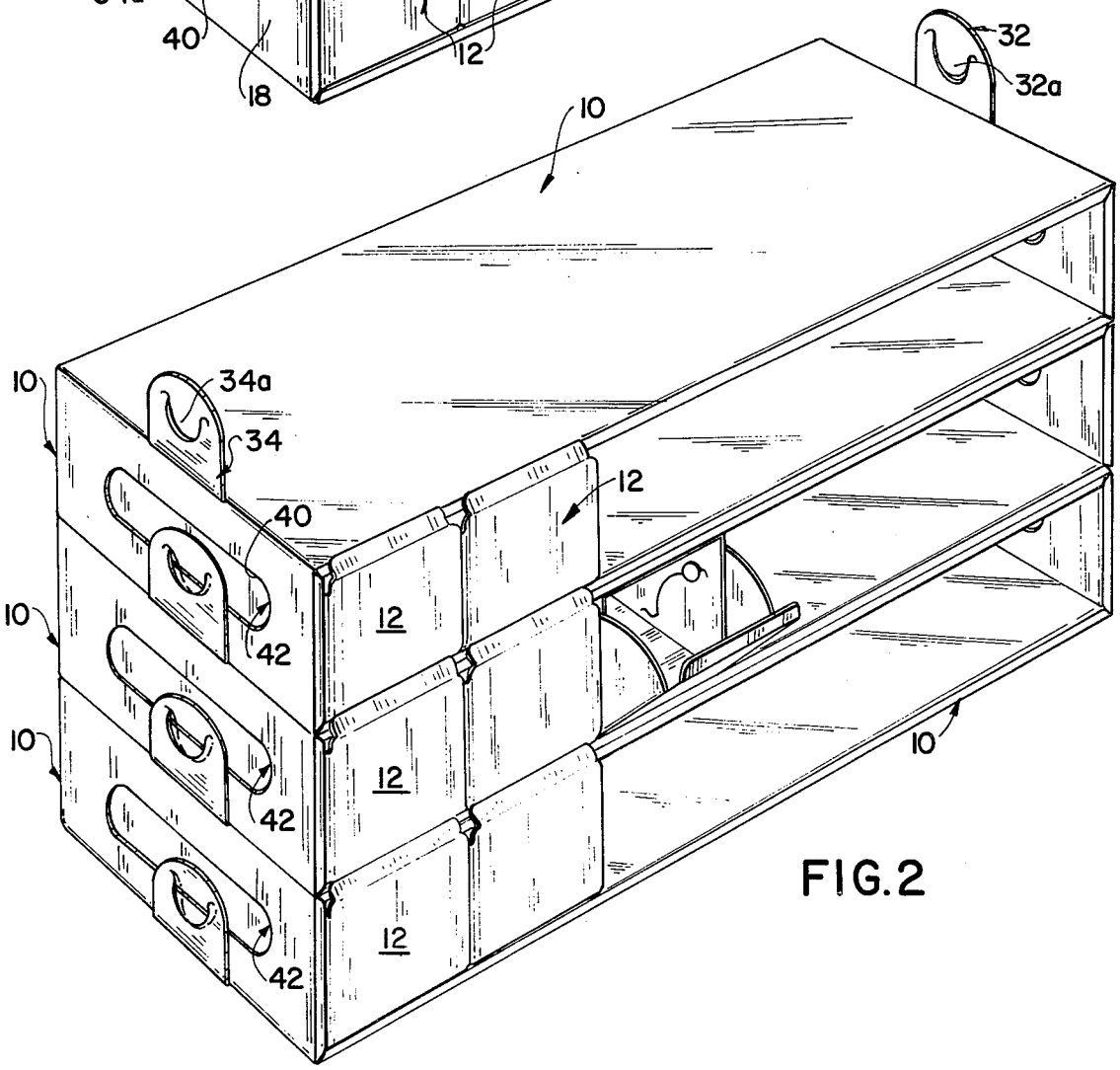
FIG.2

CONTAINER AND CABINET THEREFOR

FIELD OF THE INVENTION

The present invention relates to an improved plastic container, and specifically to such a container having a cover member pivotally connected to the container for opening and closing one end thereof, with the cover member and container walls including novel locking features for locking the cover member in an open or closed position relative to the container. The present invention also relates to cabinets for receiving and stacking the containers, with adjacent cabinets being removably detached to each other.

BACKGROUND OF THE INVENTION

Containers, and especially plastic containers, for storing and/or shipping articles are well known in the art. Typically, the container includes a pair of sidewalls, top and bottom walls, an end wall, and a cover member for opening and closing one end of the container. Such containers typically include the cover member being pivotally connected to a bottom wall of the container, so that the cover member can be pivoted to its open or closed position to easily insert or remove articles from the container. In one specific prior art arrangement, the cover member is provided with side flaps extending therefrom for interconnecting the cover member and respective sidewalls. In this particular prior art arrangement, each of the side flaps includes an arc-shaped edge and a guiding tab extending from the arc-shaped edge of the side flap for engaging and moving relative to an arc-shaped guiding slot formed in the sidewall of the container. In this manner, the cover member may be pivoted to its open or closed position, with the guiding tab and guiding slot cooperating to guide the movement of the cover member and to limit the extent to which it can be pivoted to its open position. Also, the cover member is provided with a locking tab which must be manually tucked into the container to hold the cover member closed.

Although such prior art arrangements are generally satisfactory for the purpose of storing and/or shipping articles, there have been some drawbacks. For example, the cover member and the guiding tabs do not operate to automatically lock the cover member in its open or closed position. Therefore, after the cover member has been pivoted to its closed position, the locking tab must be manually tucked into the container, or it is free to fall by itself back to its open position, especially if articles within the container apply a force to the cover member to pivot it to its open position. In addition, when the cover member is pivoted to its open position, the cover member may by itself start pivoting to its closed position requiring that at least one hand or some other means be employed to hold the cover member in its open position while articles are being removed therefrom or inserted in the container. Therefore, it would be desirable if the cover member could be automatically locked in its open and closed positions.

In addition, such hopper-type plastic containers are normally arranged in a cabinet having a plurality of walls folded into a rectangular configuration to have one open side adapted to receive a plurality of the containers in an aligned and/or stacked arrangement. When it is desired to stack a plurality of cabinets during use and/or shipment, they are merely placed on top of each other so that they are free to move relative to each other. This is undesirable, since the cabinets may move out of alignment with each other.

Broadly, it is an object of the present invention to provide an improved plastic container which overcomes one or more of the aforesaid problems. Specifically, it is within the contemplation of the present invention to provide an improved plastic container, wherein the cover member and sidewalls of the container are provided with cooperating locking features which operate to automatically lock the cover member in an open or closed position relative to the container.

It is a further object of the present invention to provide an improved cabinet for holding a plurality of containers in an aligned arrangement, with each of the cabinets including cooperating attaching features to hold a plurality of adjacent cabinets in a fixed relationship, such as in stacked arrangement.

SUMMARY OF THE INVENTION

Briefly, in accordance with the principles of the present invention, an improved plastic container is provided having a pair of sidewalls, top and bottom walls, an end wall, and a cover member for opening and closing an open end of the container. The cover member is pivotally connected to the bottom wall of the container in a hopper-type arrangement. The cover member is provided with a pair of side flaps extending from the ends thereof for interconnecting the cover member and the sidewalls of the container. Each of the side flaps includes an arc-shaped edge, and a locking tab is formed in each of the side flaps at a point spaced inwardly from the arc-shaped edge, with each of the locking tabs being movable out of the plane of its respective side flap. In addition, each of the sidewalls includes a locking slot formed therein, with each locking slot including a central curved slot portion and end slot portions forming end locking elements at each end of the central slot portion, with the end locking elements being movable out of the plane of its sidewall. Each of the locking tabs is engageable with and movable relative to its associated locking slot, such that movement of each of the locking tabs to engage one of said end locking elements operates to bias the engaged locking tab and end locking element out of their respective planes and to automatically lock the cover member in an open or closed position.

Also, in accordance with the principles of the present invention, an improved cabinet arrangement is provided, wherein each of the cabinets holds a plurality of the plastic containers in an aligned or stacked arrangement, with each of the cabinets including cooperating attaching features for holding a desired number of adjacent cabinets in a fixed relationship for stacking the cabinets and the plastic containers contained therein. Each of the cabinets includes a plurality of walls formed into a rectangular configuration having one open side adapted to receive a plurality of containers in an aligned or stacked arrangement. A strap element extends along one wall of the cabinet, with the ends of the strap element extending beyond the walls and including locking means for engaging cooperating locking means on an adjacent cabinet for releasably connecting the cabinets in a fixed relationship, such as in a stacked arrangement. In a preferred embodiment, the cooperating locking means includes locking tabs formed in the ends of the strap element for engaging recesses formed on opposite walls of the cabinet.

Advantageously, as a result of the present invention, the cover members of the plastic containers may be automatically locked in their open or closed position. As a result, when the cover member is locked in its closed position, articles and/or material contained within the container are securely held therein, and when the cover member of the container is pivoted to its open position, the cover member is securely held in its open position, so that articles may be inserted or removed from the container without requiring additional means to hold the cover member in its open position relative to the container.

The improved cabinet of the present invention also provides the advantage of releasably securing any number of cabinets in a fixed relationship, such as in a stacked arrangement, so that a large number of the plastic containers can be stacked and used.

BRIEF DESCRIPTION OF THE DRAWINGS

Further objects, features, and advantages of the present invention will becomes apparent upon the consideration of the following detailed description of a presently-preferred embodiment when taken in conjunction with the accompanying drawings, wherein:

FIG. 1 is a perspective view of an improved cabinet in accordance with the present invention;

FIG. 2 illustrates a plurality of cabinets releasably secured in a stacked arrangement in accordance with the present invention;

DETAILED DESCRIPTION OF PREFERRED EMBODIMENT OF THE INVENTION

Figure 3:
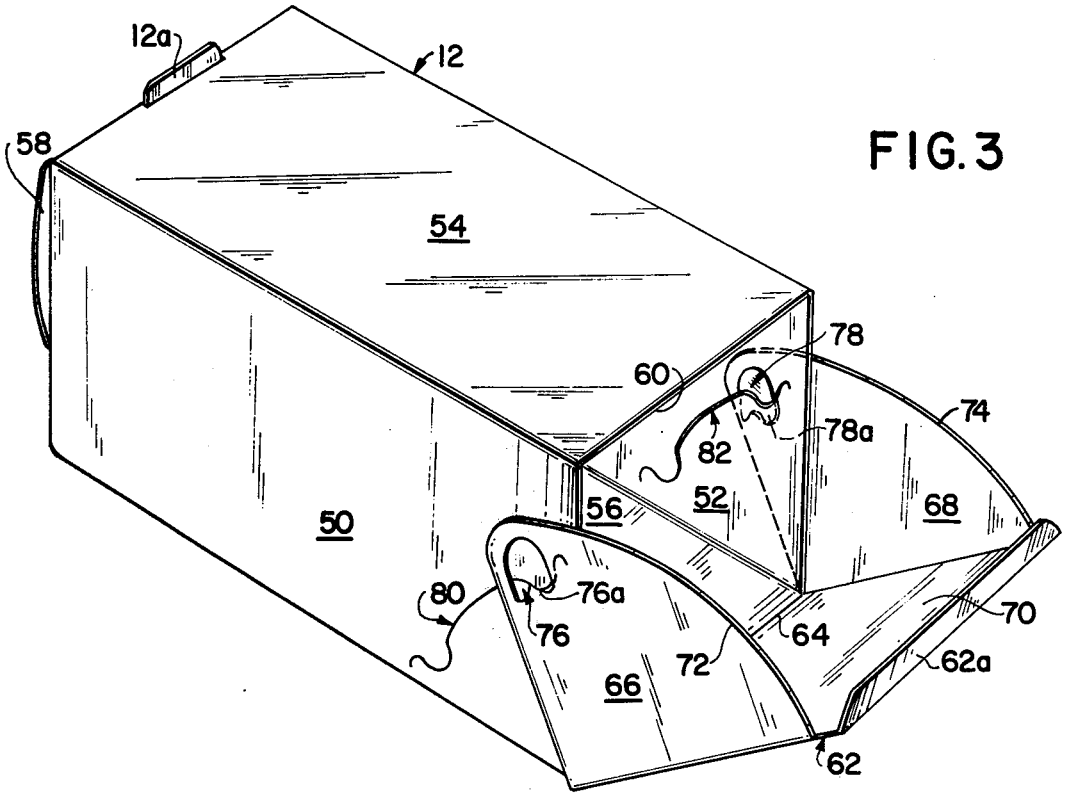
FIG. 3 is a perspective view of the improved plastic container in accordance with the present invention.

Referring now to FIG. 1, there is shown the improved cabinet of the present invention generally designated by the reference numeral 10, for holding a plurality of improved plastic containers 12 in an aligned arrangement. Cabinet 10 includes an upper wall 14, a rear wall 15, a bottom wall 16, a pair of sidewalls 18, 20, and a front opening 22 formed by the walls of the cabinet. As will be understood, the walls of cabinet 10 are folded to form the rectangular configuration, and the front opening 22 is adapted to receive a plurality of the containers 12 in an aligned arrangement. Referring briefly to FIG. 3, each container 12 includes a rear tab **12*a* for securing the container 12 within cabinet 10. As shown in FIG. 1, tabs 12*a* are insertable within a recess 14*a* formed in top wall 14** of the cabinet.

Although cabinet 10 is illustrated having a single row of containers 12, it will be understood that cabinet 10 may be provided with a plurality of rows for receiving a plurality of rows of containers 12 to form a stacked arrangement within each cabinet 10.

As shown in FIGS. 1 and 2, cabinets 10 are provided with a longitudinally-extending strap element 30 extending along the upper wall 14 of the cabinet 10. In this particular embodiment, upper wall 14 is formed of two layers of cardboard, and strap element 30 is located between the layers and is securely held in place relative thereto by any suitable means, such as adhesive or the like. Strap element 30 includes identical end locking sections 32, 34, which extend beyond the walls of the cabinet. End locking sections 32, 34 include respective locking tabs **32*a*, 34*a*** which are formed therein by cutting an arc-shaped slit in the respective locking sections.

As will be noted, respective sidewalls 18, 20 each include a carrying handle 40 formed by cutting out a section 42 from the sidewalls. In this particular embodiment, each of the sidewalls 18, 20 are formed of two layers of cardboard, with the outer layer of cardboard having the slot 42 cut therein to form handle 40.

Turning now to FIG. 2, a plurality of the cabinets 10 are shown in a stacked relationship, so that plastic containers 12 are longitudinally and vertically aligned to form a stack of containers which are easily accessible and which are maintained in a fixed relationship. As shown in FIG. 2, each end locking section 32, 34 is folded upwardly, and its associated locking tab **32*a*, 34*a* is bent out of the plane of the end locking section to engage locking slot 42 of the handle 40 of a cabinet 12 stacked above it. The locking tabs 32*a*, 34*a* securely and releasably attach a lower cabinet to an upper cabinet and maintain them in a fixed relationship, such as the stacked arrangement shown. In this manner, the individual plastic containers 12 are also held in a fixed orientation with respect to each other for storing articles for easy access and/or shipment. As will be understood, any number of cabinets 10 may be added to or removed from the stack to form a stack having the desired number of layers. Also, each of the cabinets can be formed to include two or more rows of containers. As will also be understood, cabinet 10 may be formed of materials other than cardboard, such as plastic or the like. In addition, locking section 32, 34 are formed of a bendable material, which is either resilient or flexible, such as plastic, so that the locking sections 32, 34 can be pivoted into and out of engagement with an adjacent cabinet. In addition, locking sections 32, 34** are foldable into flat engagement with a wall of the cabinet so that they are out of the way when not in use.

Handle 40 is disclosed as performing the dual function of acting as a handle and also functioning as an element of the locking arrangement between adjacent cabinets. It is also envisioned that handle 40 may be formed separate from locking slot 42, and that the separate locking slot 42 would cooperate with the respective locking elements 32, 34 for releasably connecting adjacent cabinets.

Figure 4:
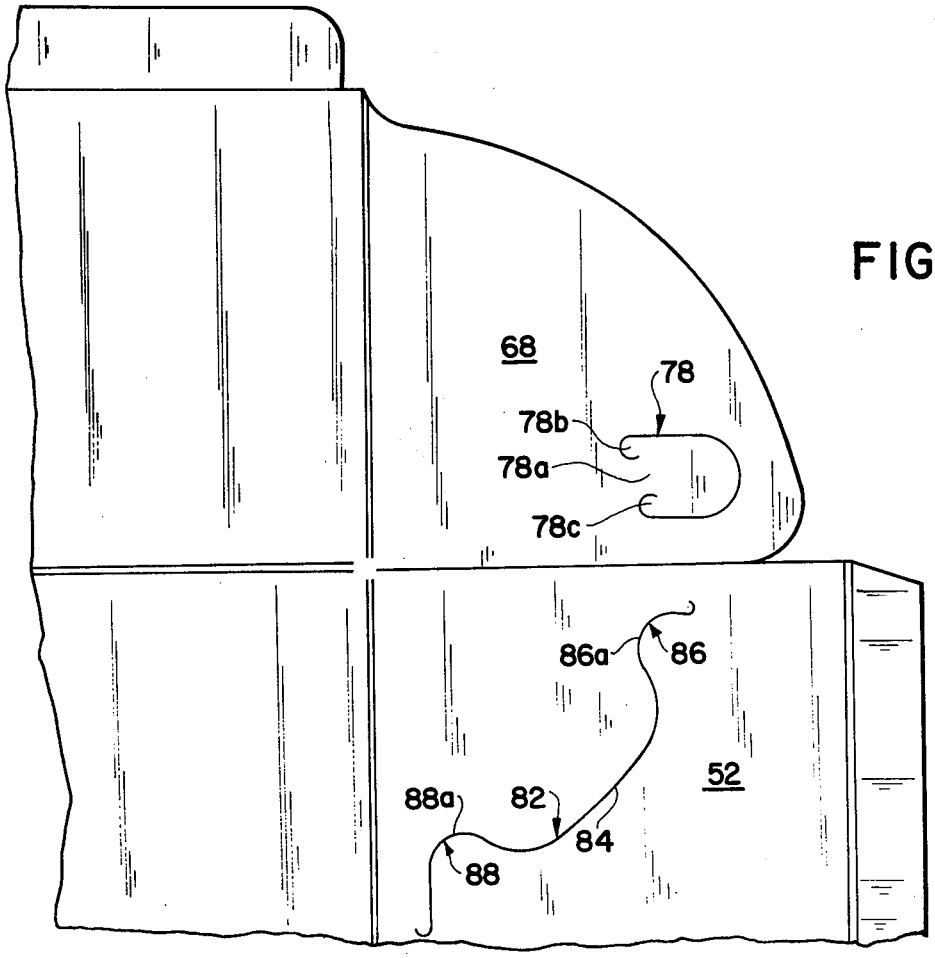
FIG. 4 is a plan view of a portion of the container shown in FIG. 3 laid out in a flat arrangement.

Turning now to FIGS. 3 and 4, the details of the plastic container 12 are illustrated. The plastic container 12 includes a pair of sidewalls 50, 52, top and bottom walls 54, 56, respectively, an end wall 58, and an open end 60. A cover member 62 is provided for opening and closing open end 60, and cover member 62 is pivotally connected along fold line 64 to bottom wall 56 to form a hopper-type container for easy insertion of or removal of articles and/or materials from the container and for convenient storage of material. Cover member 62 is provided with a pair of slide flaps 66, 68 extending from the end wall 70 of cover member 62 for interconnecting the cover member 62 and the sidewalls 50, 52 of the container 12. The side flaps 66, 68 include respective arc-shaped edges 72, 74, and spaced radially inwardly therefrom, respective locking tabs 76, 78 are provided. As tabs 76, 78 are formed spaced from the edge, rather than as an extension from the edge, the tabs have greater rigidity and structural integrity. Locking tabs 76, 78 are formed by cutting a slot having the configuration shown most clearly in FIG. 4 and are movable out of the plane of their respective side flaps about respective hinge areas **76*a*, 78*a***. As will be seen in FIG. 4, each of the hinge areas includes a pair of U-shaped locking slots 76*b*, 76*c* (78*b*, 78*c*) which are a continuation of slots 76 (78).

Referring now to the sidewalls 50, 52 of container 12, they are provided with respective locking slots 80, 82. As may be seen most clearly in FIG. 4, each locking slot includes a central slot portion 84 and end slot portions 86, 88 which form respective end locking elements 86, 88. As will be noted, central slot portion 84 is generally concave in shape, whereas end locking elements 86, 88 are essentially convex in shape, but the concave and convex sections all form a part of each of the continuous locking slots 80, 82. As will be noted, continuous locking slots 80, 82 are formed by merely cutting a continuous slot in each of the sidewalls having the configuration shown. As a result, each of the end locking elements 86, 88 is movable out of the plane of their respective sidewalls 50, 52, for a purpose to be explained.

As shown in FIG. 3, the locking tabs 76, 78 are engageable with and movable relative to their respective continuous locking slots 80, 82 so that cover member 62 may be moved between its open and closed position to provide a container having a hopper-type opening. As will be noted, when cover member 62 is moved to its completely open or completely closed position, such movement causes each of the locking tabs 76, 78 to engage one of the end locking elements 86 or 88 at the open or closed position and operates to bias each engaged locking tab and end locking element out of their respective planes and to lock the cover member in its open or closed position. As will be understood, the nose portion 86*a* or 88*a* of respective end locking elements 86 or 88 overlaps and applies pressure to the hinge point 76*a* (or 78*a*) of the locking tab 76 (or 78) so that the cover member 62 is locked in its open or closed position. As will also be understood, when locking tab 76 (or 78) is moved to the open position, U-shaped locking slot 76*b* (78*b*) is constructed to receive and engage its respective end locking element 86 to lock cover member 62 in its open position. When locking tab 76 (or 78) is moved to the closed position, U-shaped locking slot 76*c* (78*c*) is contructed to receive and engage its respective end locking element 88 to lock cover member 62 in its closed position.

In this manner, by simply pivoting cover member 62 to its open or closed position, locking tabs 76, 78 are automatically engaged with their associated end locking elements 86 or 88, and as a result, the cover member 62 is automatically locked in its completely open or completely closed position. As an added locking feature, cover member 62 is provided with a tab 62*a* which may be tucked into the open end 60 of the container 12 in order to additionally secure the cover member 62 in its closed position.

In view of the foregoing, it shall be appreciated that in accordance with the present invention, there has been provided an improved plastic container which includes novel locking features for automatically locking the cover member in its open or closed position. In addition, the plastic containers are placed in cabinet 10 and are securely held therein for easy access through the hopper-type cover member 62. Advantageously, any number of cabinets 10 may be releasably secured together to maintain the containers 12 in a stacked arrangement of the desired height. Such a modular construction conveniently allows cabinets to be added to or removed from the stacked arrangement of cabinets so that the number of available stacked containers is easily increased or decreased.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. In a plastic container having a pair of sidewalls, top and bottom walls, an end wall, and a cover member for opening and closing an open end of said container, said cover member being pivotally connected to said bottom wall, said cover member including a pair of side flaps extending therefrom for interconnecting said cover member and said sidewalls, the improvement comprising: said side flaps each having a locking tab formed therein such that said locking tab is movable out of the plane of said side flap, each of said sidewalls including a locking slot formed therein, said locking slot including a central slot portion and end slot portions forming end locking elements at each end of said central slot portion, said end locking elements being movable out of the plane of each of said sidewalls, said locking tabs being engageable with and movable relative to said respective locking slots such that movement of each of said locking tabs to engage one of said end locking elements on each of said sidewalls operates to bias each of said engaged locking tabs and end locking elements out of their respective planes to automatically lock said cover member in an open or closed position.

2. In a plastic container in accordance with claim 1, wherein each of said locking tabs is formed in its respective side flap at a point spaced inwardly from its respective edge.

3. In a plastic container in accordance with claims 1 or 2, wherein each of said locking tabs includes a hinge area at one end about which said locking tab is movable out of the plane of its associated side flap.

4. In a plastic container in accordance with claim 1, wherein said central slot portions and said associated end slot portions are formed from a continuous locking slot, and said central slot portion is essentially concave in shape, and said end slot portions are essentially convex in shape.

5. In a plastic container in accordance with claim 3, wherein each of said end locking elements includes a nose portion, such that when each of said locking tabs is in engagement with one of said end locking elements, its nose portion is in engagement with the hinge point of the associated locking tab to securely lock the cover member in its open or closed position.

6. In a plastic container in accordance with claim 3, wherein said hinge area of each of said locking tabs includes a pair of U-shaped locking slots, each of said U-shaped locking slots constructed and arranged for receiving an associated one of said respective end locking elements to automatically lock said cover member in an open or closed position.

* * * * *